US011165212B1

(12) United States Patent
Chuan

(10) Patent No.: US 11,165,212 B1
(45) Date of Patent: Nov. 2, 2021

(54) CRIMPING DEVICE FOR A CABLE TERMINAL

(71) Applicant: Kudos Mechanical Co., Ltd., New Taipei (TW)

(72) Inventor: James Chuan, New Taipei (TW)

(73) Assignee: Kudos Mechanical Co., Ltd., New Taipei (TW)

( * ) Notice: Subject to any disclaimer, the term of this patent is extended or adjusted under 35 U.S.C. 154(b) by 0 days.

(21) Appl. No.: 17/102,914

(22) Filed: Nov. 24, 2020

(30) Foreign Application Priority Data

Oct. 15, 2020 (TW) ..... 109135680

(51) Int. Cl.
*H01R 43/058* (2006.01)

(52) U.S. Cl.
CPC ..... *H01R 43/058* (2013.01); *Y10T 29/53235* (2015.01)

(58) Field of Classification Search
CPC .... H01R 43/0428; H01R 43/058; B21J 13/04; Y10T 29/53235; Y10T 29/5327
USPC ..... 29/748, 753, 761
See application file for complete search history.

(56) References Cited

U.S. PATENT DOCUMENTS 6,230,542 B1 5/2001 Frenken
6,276,186 B1 8/2001 Frenken
7,124,619 B1 * 10/2006 Lefavour ..... B21J 13/04 72/456
7,299,542 B2 * 11/2007 Montena ..... H01R 43/042 29/748
9,774,159 B2 * 9/2017 Hamm ..... H01R 43/0427

* cited by examiner

*Primary Examiner* — Donghai D Nguyen
(74) *Attorney, Agent, or Firm* — Thomas J. Nikolai; DeWitt LLP

(57) ABSTRACT

A crimping device for a cable terminal has a crimping base, a driving assembly, a die mount, and a connector. The connector connects the crimping base and the die mount. The die mount is driven by the driving assembly to linearly move back and forth. A mutual pulling force is formed between the crimping base and the die mount. When compressing, deformation of the crimping base can be effectively reduced, and a service life of the crimping base can be extended. Moreover, the die mount does not move laterally, thereby avoiding the situation that the driving assembly would be failed after long-term used.

14 Claims, 8 Drawing Sheets

CRIMPING DEVICE FOR A CABLE TERMINAL

BACKGROUND OF THE INVENTION

1. Field of the Invention

The present invention relates to a crimping device, especially to a crimping device for a cable terminal.

2. Description of the Prior Art(s)

An electrical is an assembly of one or more wires running side by side or bundled and is used to carry electric current. Ends of those wires are crimped or welded together or are wrapped by an insulating tape, so as to form electrical connection between those wires. "Crimping" refers to mounting a sleeve portion of a cable terminal around the bared ends of the wires, and then radially compressing the sleeve portion of the cable terminal with a crimping device to reshape the sleeve portion and to integrate the cable terminal and the wires.

A conventional crimping device comprises a crimping base and a die mount. The crimping base is substantially C-shaped and has a first end portion and a second end portion protruding laterally and disposed oppositely on the crimping base. An opening is defined between the first end portion and the second end portion. A hydraulic cylinder is mounted to the second end portion of the crimping base. The die mount is disposed between the first end portion and the second end portion of the crimping base and is connected to and is driven by the hydraulic cylinder to linearly move back and forth to approach or depart from the first end portion. Two crimping dies are mounted to the first end portion of the crimping base and the die mount respectively. Each of the crimping dies has a die cavity.

Before crimping, the sleeve portion of the cable terminal is mounted around the ends of the wires and then the sleeve portion along with the wires are disposed in the die cavity of the crimping die that is mounted on the first end portion of the crimping base. When crimping, the die mount and the crimping die on the die mount are driven to move toward the first end portion of the crimping base. As the two crimping dies abut against each other, the sleeve portion in the die cavities of the two crimping dies is compressed and reshaped. Accordingly, the cable terminal and the wires are tightly integrated together.

However, during compressing the sleeve portion of the cable terminal, the die mount has to continuously apply force, which is sufficient to deform the sleeve portion, to the first end portion of the crimping base, causing the crimping base to slightly bend until the die mount is moved away. Under such repetitive loading and unloading, the first end portion of the crimping base breaks up easily due to metal fatigue.

In addition, the hydraulic cylinder that drives the die mount substantially has a cylinder tube and a piston rod. An end of the piston rod is disposed in the cylinder while another end of the piston rod is connected to the die mount, and the piston rod is driven to move back and forth relative to the cylinder tube. When the piston rod moves forward, the die mount is driven to move toward the first end portion of the crimping base and the sleeve portion of the cable terminal that is disposed in the die cavities of the two crimping dies is compressed.

Since the two crimping dies have to apply a great compression force to the sleeve portion, the piston rod that is connected to the die mount buckles easily, causing the die mount and the crimping dies on the die mount to slightly move laterally, especially move toward the opening defined between the first end portion and the second end portion of the crimping base. Since the piston rod is inclined with respect to an axis of the cylinder tube, a gap is gradually formed between the cylinder tube and the piston rod due to mutual wear. When the gap becomes larger, the piston rod would be stuck in the cylinder tube easily due to being unable to move parallel to the axis of the cylinder tube while moving back and forth.

To overcome the shortcomings, the present invention provides a crimping device for a cable terminal to mitigate or obviate the aforementioned problems.

SUMMARY OF THE INVENTION

The main objective of the present invention is to provide a crimping device that has strengthened structure and durability. The crimping device has a crimping base, a driving assembly, a die mount, and a connector.

The crimping base has an extension portion, a first end portion, and a second end portion. The extension portion has a guiding channel and an engaging channel formed in a side surface of the extension portion. The first end portion protrudes laterally from a front end of the extension portion. The second end portion protrudes laterally from a rear end of the extension portion.

The driving assembly is mounted to the second end portion of the crimping base.

The die mount is disposed between the first end portion and the second end portion of the crimping base, is connected to the driving assembly and is driven by the driving assembly.

The connector is securely connected with the die mount is slidable in the guiding channel and the engaging channel of the extension portion of the crimping base, and slidably engages in the engaging channel.

With the connector connecting the crimping base and the die mount, a mutual pulling force can be formed between the crimping base and the die mount. When compressing a sleeve portion of a cable terminal and ends of multiple wires, deformation of the crimping base can be effectively reduced, and a service life of the crimping base can be extended. Moreover, with the mutual pulling force between the crimping base and the die mount, the die mount does not move laterally, thereby avoiding the situation that the driving assembly would be failed after long-term used.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
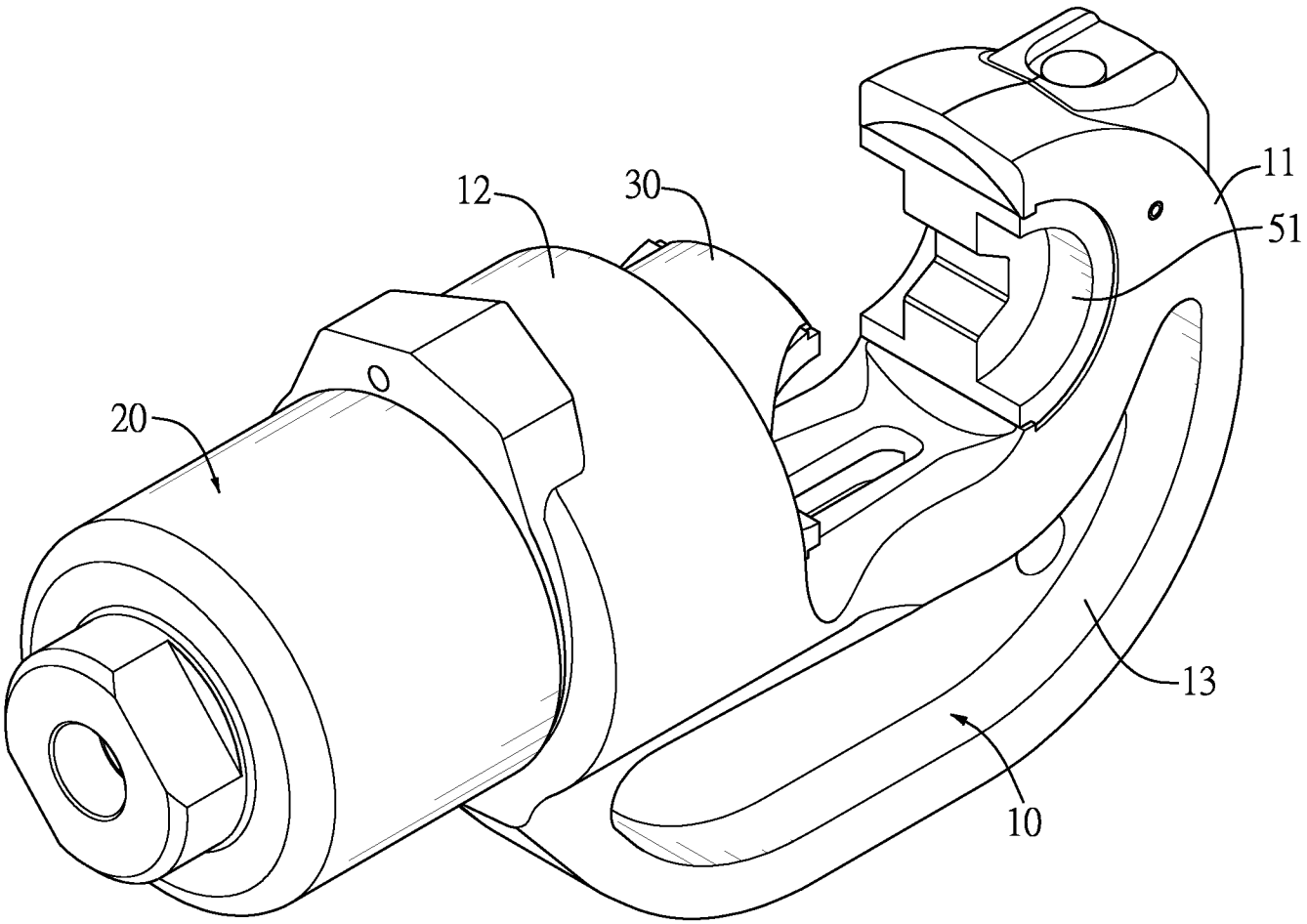
FIG. 1 is a perspective view of a crimping device for a cable terminal in accordance with the present invention.
Figure 2:
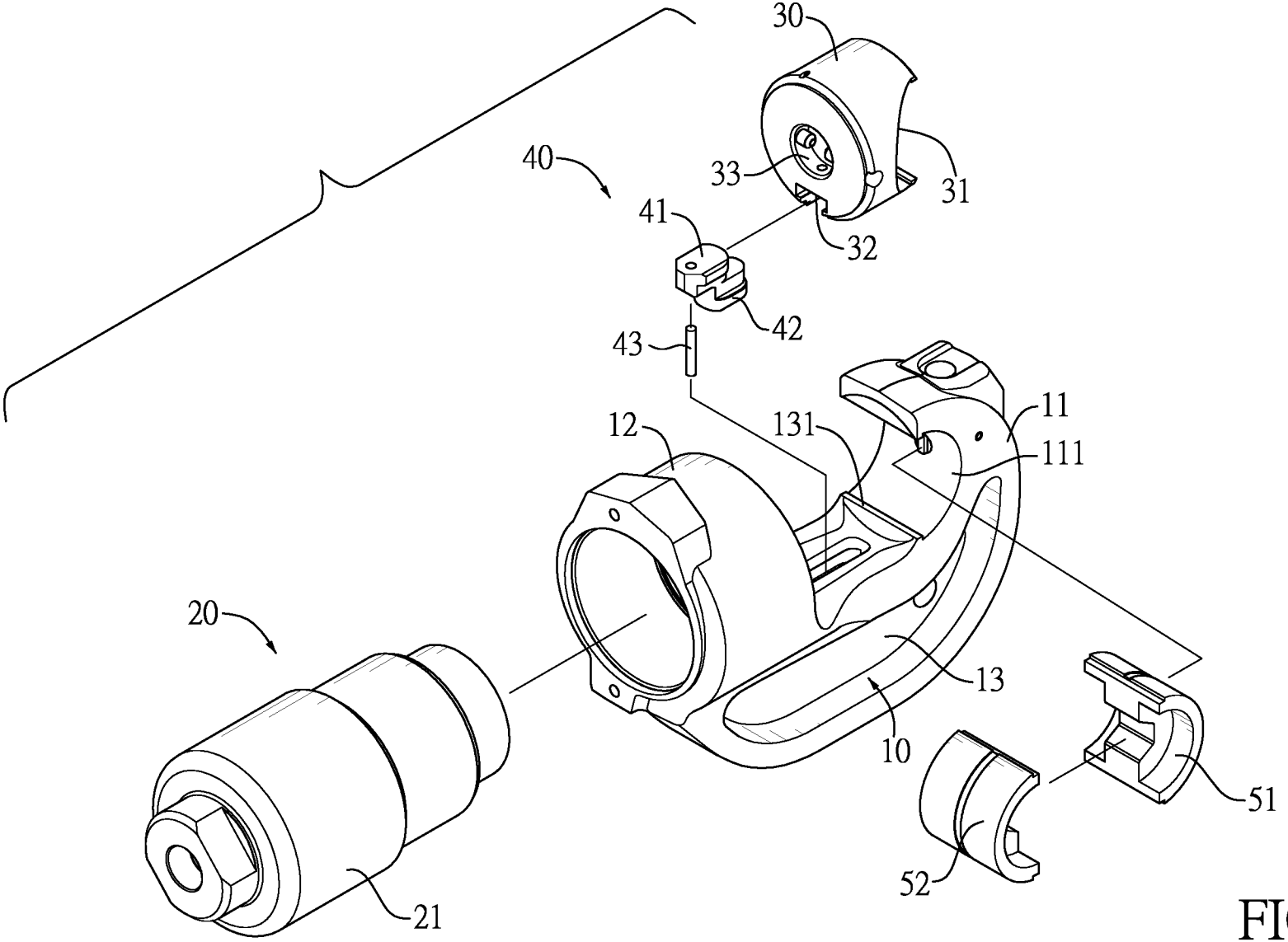
FIG. 2 is an exploded perspective view of the crimping device in FIG. 1.

With reference to FIGS. 1 and 2, a crimping device for a cable terminal in accordance with the present invention comprises a crimping base 10, a driving assembly 20, a die mount 30, and a connector 40.

Figure 3:
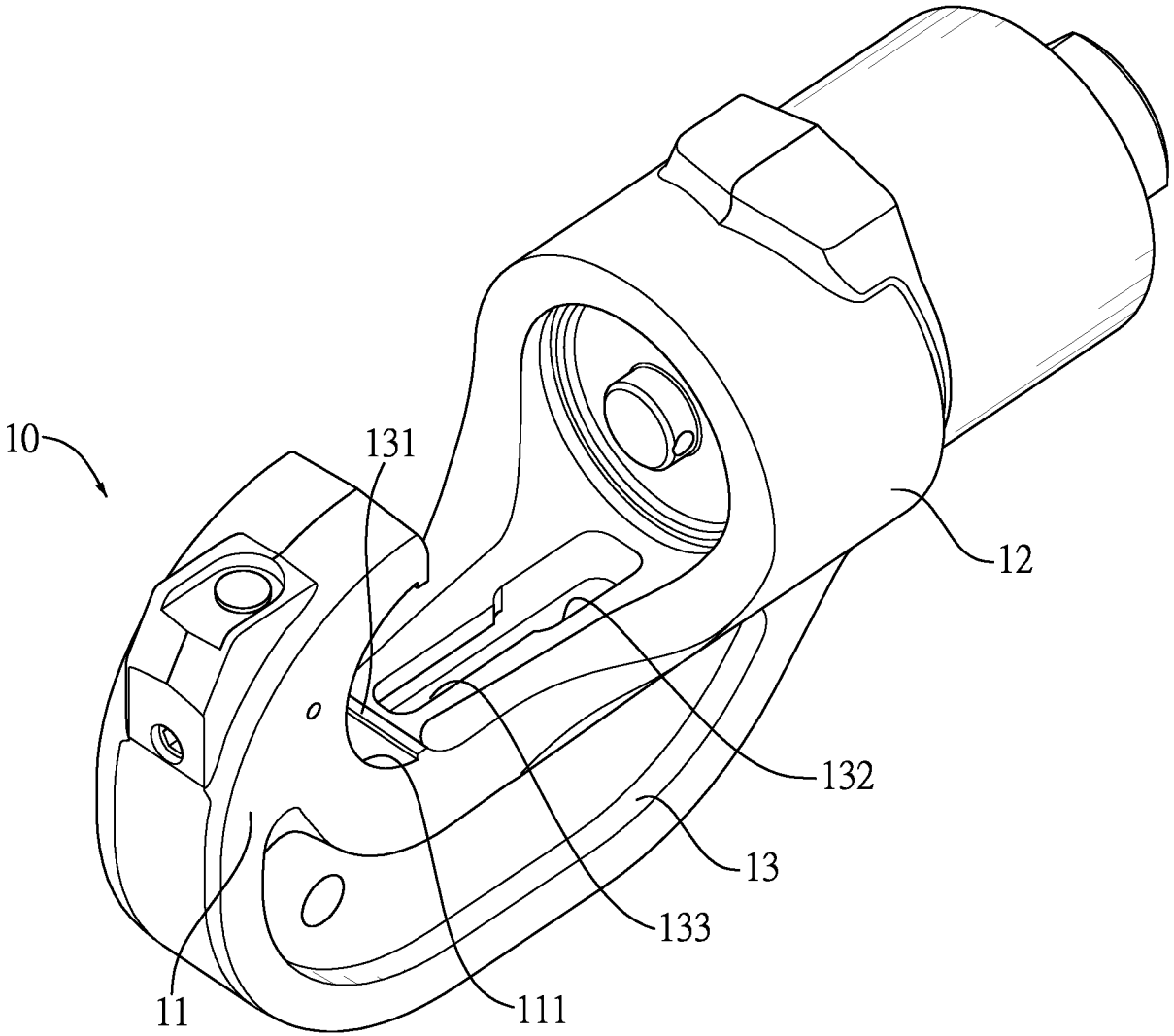
FIG. 3 is a perspective view of a crimping base and a driving assembly of the crimping device in FIG. 1.

With further reference to FIG. 3, the crimping base 10 is substantially C-shaped and has an extension portion 13, a first end portion 11, and a second end portion 12.

Figure 5:
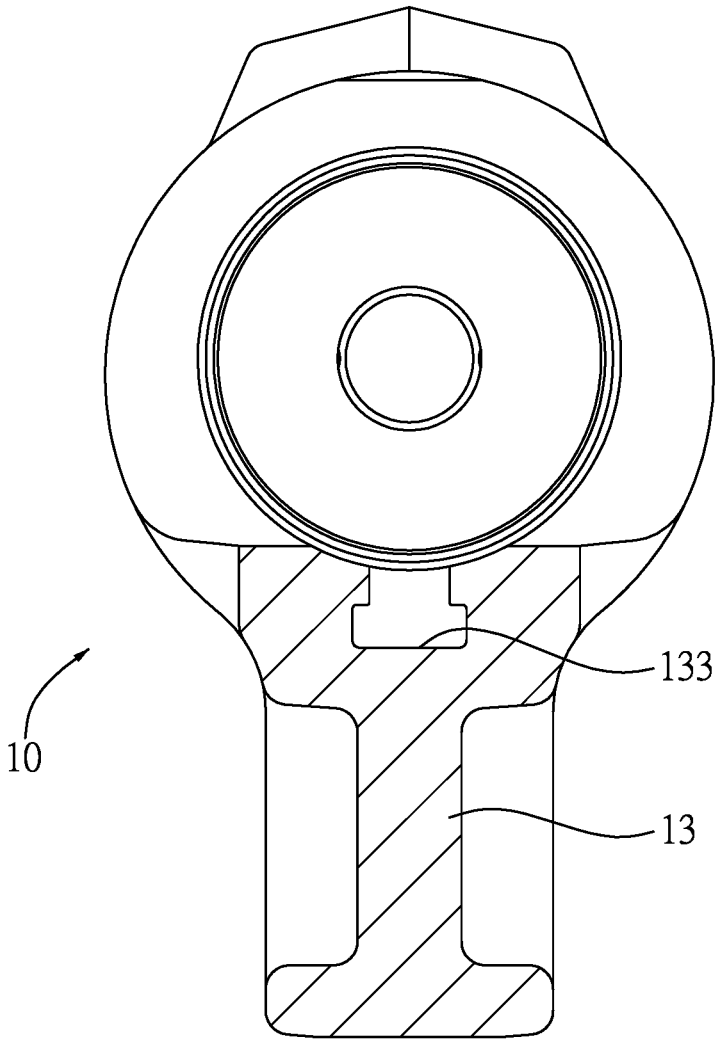
FIG. 5 is a cross-sectional end view of the crimping device in FIG. 1.
Figure 6:
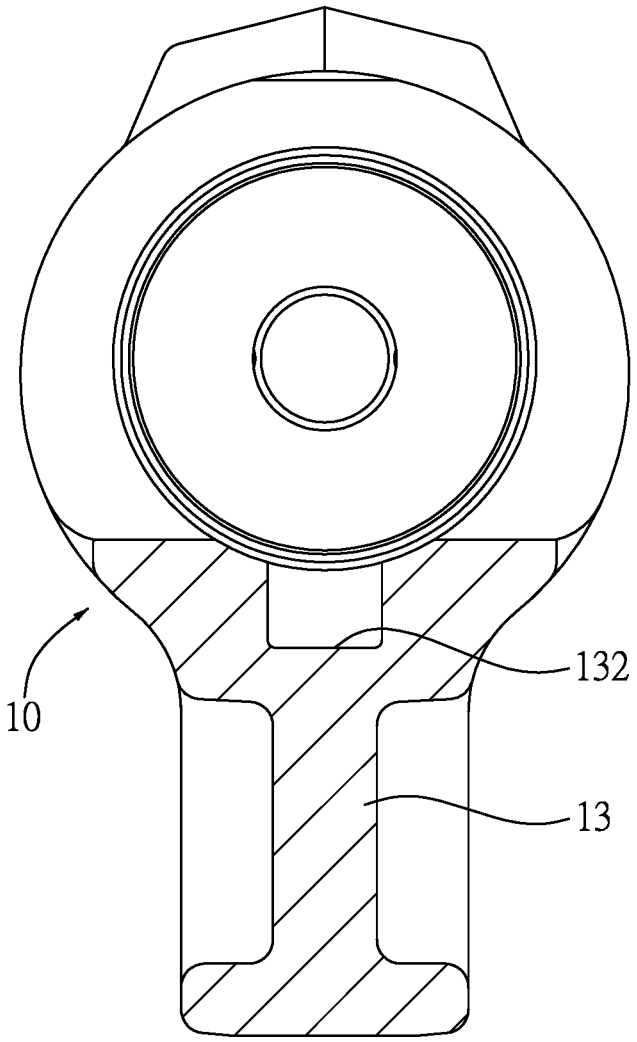
FIG. 6 is another cross-sectional end view of the crimping device in FIG. 1.

With further reference to FIGS. 5 and 6, the extension portion 13 has a front end, a rear end, a side surface, a stop protrusion 131, a guiding channel 132, and an engaging channel 133. The front end and the rear end are defined oppositely on the extension portion 13. The stop protrusion 131 is formed on the side surface of the extension portion 13 and is disposed close to the front end of the extension portion 13.

As shown in FIG. 5, the guiding channel 132 is formed in the side surface of the extension portion 13 and is disposed close to the rear end of the extension portion 13.

As shown in FIG. 6, the engaging channel 133 is formed in the side surface of the extension portion 13, is disposed between the front end of the extension portion 13 and the guiding channel 132, and is disposed between the stop protrusion 131 and the guiding channel 132 with an end of the engaging channel 133 communicating with the guiding channel 132. The engaging channel 133 forms an opening on the side surface of the extension portion 13. A width of the opening of the engaging channel 133 is smaller than a width of a bottom of the engaging channel 133.

The first end portion 11 protrudes laterally from the front end of the extension portion 13 and has an end surface and a die recess 111. The die recess 111 is formed in the end surface of the first end portion 11 and is for mounting a crimping die 51.

The second end portion 12 protrudes laterally from the rear end of the extension portion 13 and corresponds in position to the first end portion 11. The end surface of the first end portion 11 faces toward the second end portion 12. The stop protrusion 131, the engaging channel 133, and the guiding channel 132 are disposed between the first end portion 11 and the second end portion 12 in series.

Figure 7:
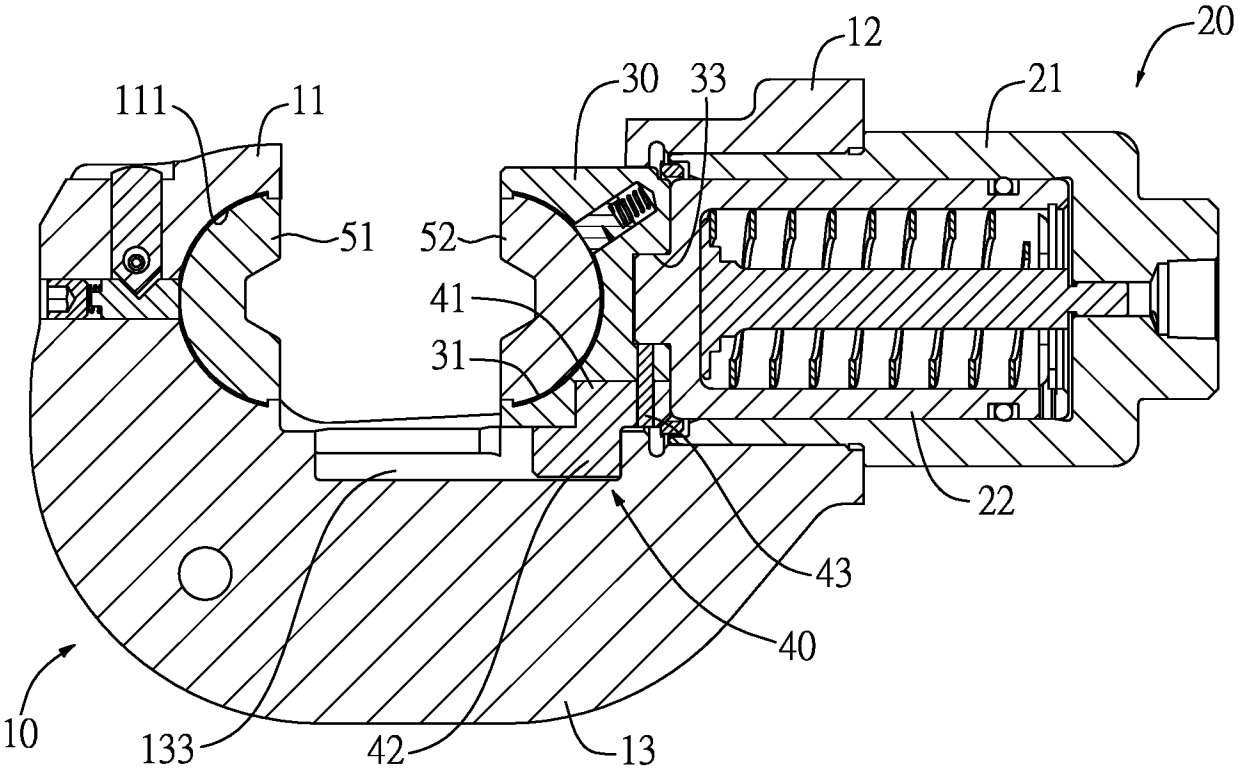
FIG. 7 is a cross-sectional side view of the crimping device in FIG. 1.

With further reference to FIG. 7, the driving assembly 20 is mounted to the second end portion 12 of the crimping base 10. In the preferred embodiment, the driving assembly 20 is a hydraulic cylinder and has a cylinder tube 21 and a piston rod 22. The piston rod 22 has two opposite ends. One of the ends of the piston rod 22 is disposed in the cylinder tube 21. The other end of the piston rod 22 protrudes out of the cylinder tube 21. The piston rod 22 is driven to move back and forth relative to the cylinder tube 21.

Figure 4:
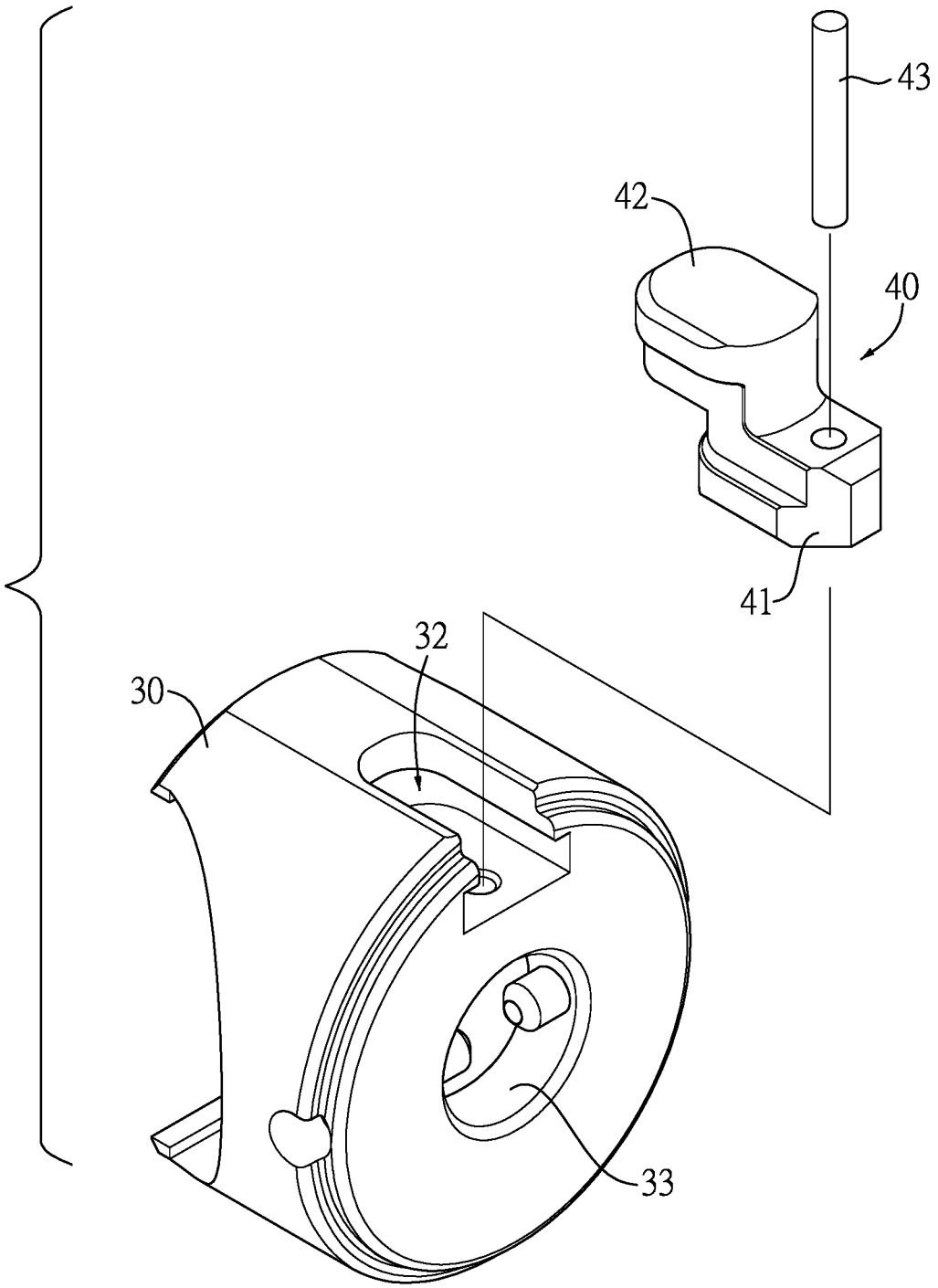
FIG. 4 is an exploded perspective view of a die mount and a connector of the crimping device in FIG. 1.

With further reference to FIG. 4, the die mount 30 is disposed between the first end portion 11 and the second end portion 12 of the crimping base 10, is connected to the piston rod 22 of the driving assembly 20, and is driven by the driving assembly 20 to linearly move back and forth to depart from or approach the first end portion 11. The die mount 30 has an annular side surface, a front end surface, a rear end surface, a die recess 31, a connecting recess 32, and an end recess 33. The front end surface of the die mount 30 faces toward the first end portion 11 of the crimping base 10. The rear end surface of the die mount 30 faces toward the second end portion 12 of the crimping base 10 and is connected with the driving assembly 20.

The die recess 31 of the die mount 30 is formed in the front end surface of the die mount 30 and is for mounting a crimping die 52. The connecting recess 32 is formed in the annular side surface of the die mount 30 and is defined through the rear end surface of the die mount 30. The connecting recess 32 forms an opening on the annular side surface of the die mount 30. A width of the opening of the connecting recess 32 is smaller than a width of a bottom of the connecting recess 32. The end recess 33 is formed in the rear end surface of the die mount 30.

The connector 40 has a fixed connecting portion 41 and a sliding connecting portion 42. The fixed connecting portion 41 is disposed in the connecting recess 32 of the die mount 30 and is securely connected with the die mount 30. Specifically, a cross-sectional shape of the fixed connecting portion 41 corresponds in shape and size to a cross-sectional shape of the connecting recess 32 of the die mount 30, such that the fixed connecting portion 41 engages in the connecting recess 32. The sliding connecting portion 42 is slidably engages in the engaging channel 133 of the extension portion 13 of the crimping base 10. Specifically, a cross-sectional shape of the sliding connecting portion 42 corresponds in shape and size to a cross-sectional shape of the engaging channel 133. When mounting the die mount 30 to the crimping base 10, the sliding connecting portion 42 is mounted into the guiding channel 132 of the extension portion 13. Then the sliding connecting portion 42 is able to further slide into the engaging channel 133.

In the preferred embodiment, a pin 43 is mounted through and tightly fits to the fixed connecting portion 41 of the connector 40 and the die mount 30, so as to securely connect the connector 40 and the die mount 30. Specifically, the pin 43 is disposed along a radial direction of the die mount 30. An end of the pin 43 is tightly fitted in the fixed connecting portion 41 of the connector 40 and another end of the pin 43 is tightly fitted in the die mount 30 and protrudes toward the end recess 33 of the die mount 30. Thus, the pint 43 can be pushed from any one of the ends, so as to be detached from the connector 40 and the die mount 30. Accordingly, the connector 40 can be dismounted from the die mount 30 and replaced with a new one.

In the preferred embodiment, the engaging channel 133 of the extension portion 13 of the crimping base 10 and the guiding channel 32 of the die mount 30 are T-shaped in cross-section. The sliding connecting portion 42 and the fixed connecting portion 41 of the connector 40 are also T-shaped in cross-section, such that the sliding connecting portion 42 and the fixed connecting portion 41 are able to engage in the engaging channel 133 and the guiding channel 32 respectively.

However, shapes of the sliding connecting portion 42, the fixed connecting portion 41, the engaging channel 133, and the guiding channel 32 are not limited to the shapes as described above. The engaging channel 133 may be tapered from the bottom to the opening on the side surface of the extension portion 13 and is formed in trapezoid shape, i.e. dovetail shape. The guiding channel 32 may be tapered from the bottom to the opening on the on the annular side surface of the die mount 30 and is formed in trapezoid shape, i.e. dovetail shape. As for the connector 40, the cross-sectional shapes of the sliding connecting portion 42 and the fixed connecting portion 41 may be trapezoid shape, i.e. dovetail shape, such that the sliding connecting portion 42 and the fixed connecting portion 41 are able to engage in the engaging channel 133 and the guiding channel 32 respectively.

Figure 8:
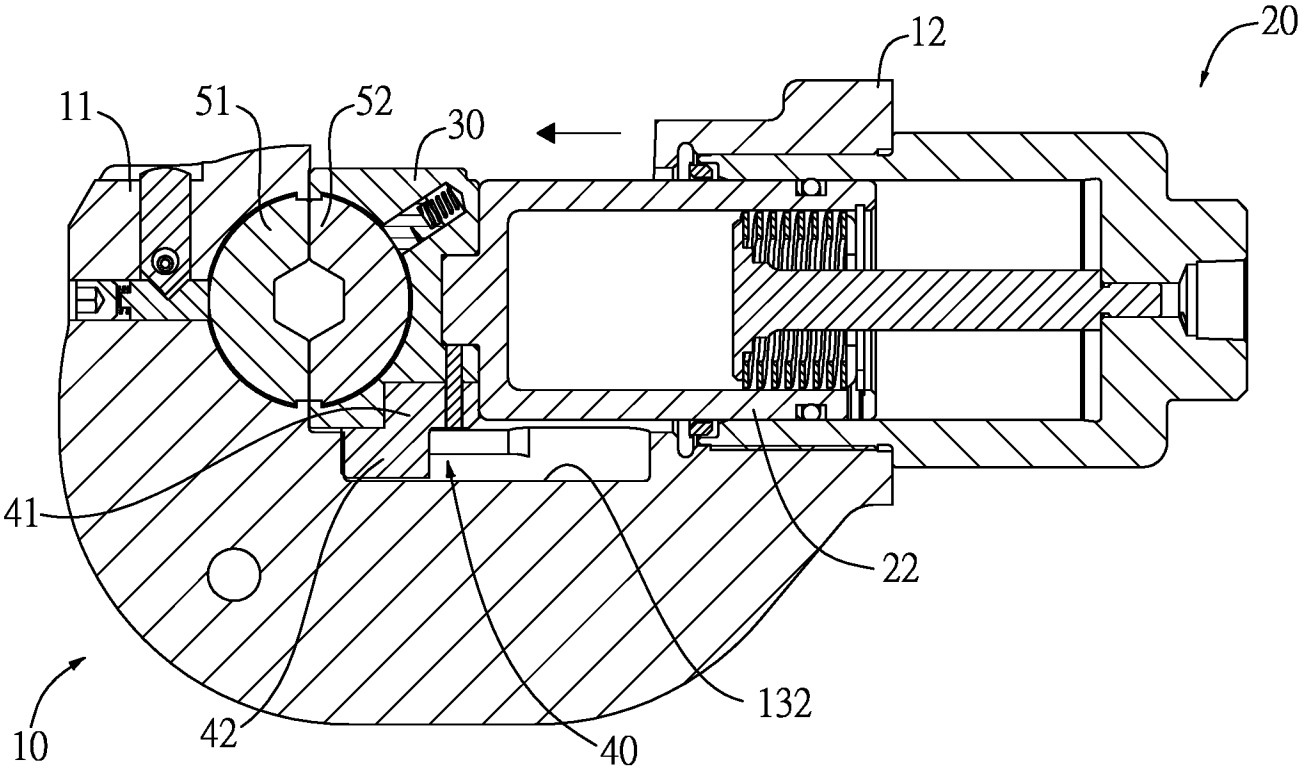
FIG. 8 is an operational cross-sectional side view of the crimping device in FIG. 1.

With reference to FIGS. 7 and 8, the crimping device for the cable terminal as described has the following advantages. With the connector 40 connecting the crimping base 10 and the die mount 30, a mutual pulling force can be formed between the crimping base 10 and the die mount 30. Thus, when compressing a sleeve portion of a cable terminal and ends of multiple wires, deformation of the crimping base 10 caused by a compression force from the die mount 30 and the driving assembly 20 can be effectively reduced, and a service life of the crimping base 10 can be extended. Specifically, number of times that the crimping base 10 can be used from crimping the cable terminal can be increased from more than 20,000 to 40,000-50,000.

Moreover, with the mutual pulling force between the crimping base 10 and the die mount 30, the piston rod 22 does not buckle easily and the die mount 30 does not move laterally, thereby avoiding the situation that the driving assembly 20 would be failed after long-term used.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A crimping device for crimping a cable terminal, and the crimping device comprising:

a crimping base having an extension portion having a guiding channel formed in a side surface of the extension portion; and an engaging channel formed in the side surface of the extension portion, and disposed between a front end of the extension portion and the guiding channel with an end of the engaging channel communicating with the guiding channel, wherein the engaging channel forms an opening on the side surface of the extension portion, and a width of the opening of the engaging channel is smaller than a width of a bottom of the engaging channel;

a first end portion protruding laterally from the front end of the extension portion; and a second end portion protruding laterally from a rear end of the extension portion and corresponding in position to the first end portion;

a driving assembly mounted to the second end portion of the crimping base;

a die mount disposed between the first end portion and the second end portion of the crimping base, connected to the driving assembly and driven by the driving assembly to linearly move back and forth to depart from or approach the first end portion, the die mount having a connecting recess, and the connecting recess formed in an annular side surface of the die mount; and a connector having a fixed connecting portion disposed in the connecting recess of the die mount and securely connected with the die mount; and a sliding connecting portion slidably engaging in the engaging channel of the extension portion of the crimping base, wherein a cross-sectional shape of the sliding connecting portion corresponds in shape and size to a cross-sectional shape of the engaging channel and the sliding connecting portion is slidable in the guiding channel and the engaging channel of the extension portion of the crimping base.

2. The crimping device as claimed in claim 1, wherein the connecting recess of the die mount is defined through a rear end surface of the die mount, the connecting recess forms an opening on the annular side surface of the die mount, and a width of the opening of the connecting recess is smaller than a width of a bottom of the connecting recess; and a cross-sectional shape of the fixed connecting portion corresponds in shape and size to a cross-sectional shape of the connecting recess of the die mount.

3. The crimping device as claimed in claim 2, wherein the engaging channel of the extension portion of the crimping base is T-shaped in cross-section.

4. The crimping device as claimed in claim 3, wherein the guiding channel of the die mount is T-shaped in cross-section.

5. The crimping device as claimed in claim 2, wherein the guiding channel of the die mount is T-shaped in cross-section.

6. The crimping device as claimed in claim 2, wherein the die mount further has an end recess formed in the rear end surface of the die mount; and a pin is mounted through and tightly fits to the fixed connecting portion of the connector and the die mount, and is disposed along a radial direction of the die mount with an end of the pin tightly fitted in the fixed connecting portion of the connector and another end of the pin tightly fitted in the die mount and protruding toward the end recess of the die mount.

7. The crimping device as claimed in claim 2, wherein the extension portion of the crimping base further has a stop protrusion formed on the side surface of the extension portion and disposed close to the front end of the extension portion; and the engaging channel of the extension portion is disposed between the stop protrusion and the guiding channel.

8. The crimping device as claimed in claim 2, wherein the first end portion of the crimping base has an end surface faces toward the second end portion of the crimping base; and a die recess formed in the end surface of the first end portion; and the die mount has a front end surface faces toward the first end portion of the crimping base; and a die recess formed in the front end surface of the die mount.

9. The crimping device as claimed in claim 2, wherein the driving assembly has a cylinder tube; and a piston rod having two opposite ends, and one of the ends of the piston rod disposed in the cylinder tube and the other end of the piston rod protruding out of the cylinder tube and connected to the die mount, wherein the piston rod is driven to move back and forth relative to the cylinder tube.

10. The crimping device as claimed in claim 1, wherein the engaging channel of the extension portion of the crimping base is T-shaped in cross-section.

11. The crimping device as claimed in claim 1, wherein the die mount further has an end recess formed in an rear end surface of the die mount; and a pin is mounted through and tightly fits to the fixed connecting portion of the connector and the die mount, and is disposed along a radial direction of the die mount with an end of the pin tightly fitted in the fixed connecting portion of the connector and another end of the pin tightly fitted in the die mount and protruding toward the end recess of the die mount.

12. The crimping device as claimed in claim 1, wherein the extension portion of the crimping base further has a stop protrusion formed on the side surface of the extension portion and disposed close to the front end of the extension portion; and the engaging channel of the extension portion is disposed between the stop protrusion and the guiding channel.

13. The crimping device as claimed in claim 1, wherein the first end portion of the crimping base has an end surface faces toward the second end portion of the crimping base; and a die recess formed in the end surface of the first end portion; and the die mount has a front end surface faces toward the first end portion of the crimping base; and a die recess formed in the front end surface of the die mount.

14. The crimping device as claimed in claim 1, wherein the driving assembly has a cylinder tube; and a piston rod having two opposite ends, and one of the ends of the piston rod disposed in the cylinder tube and the other end of the piston rod protruding out of the cylinder tube and connected to the die mount, wherein the piston rod is driven to move back and forth relative to the cylinder tube.

* * * * *